US007174907B2

(12) United States Patent
Goldsmith et al.

(10) Patent No.: US 7,174,907 B2
(45) Date of Patent: Feb. 13, 2007

(54) BASKETCANE

(76) Inventors: Michael Alexander Goldsmith, 75-58 192nd St., Flushing, NY (US) 11366; Elizabeth Ann Goldsmith, 75-58 192nd St., Flushing, NY (US) 11366

( * ) Notice: Subject to any disclaimer, the term of this patent is extended or adjusted under 35 U.S.C. 154(b) by 39 days.

(21) Appl. No.: 11/130,060

(22) Filed: May 16, 2005

(65) Prior Publication Data

US 2006/0254629 A1 Nov. 16, 2006

(51) Int. Cl.
*A45B 3/00* (2006.01)

(52) U.S. Cl. ..... 135/66; 135/16; 135/34.2; 224/407

(58) Field of Classification Search ..... 135/16–17, 135/65, 66; 224/407, 915; 248/156, 219.4, 248/97–100; D3/7–8, 10–11
See application file for complete search history.

(56) References Cited

U.S. PATENT DOCUMENTS 1,526,246 A * 2/1925 Simek ..... 150/123
1,838,986 A * 12/1931 Callender ..... 135/85
2,210,493 A * 8/1940 Lisi ..... 135/66
2,682,904 A * 7/1954 Divine ..... 383/71
4,940,201 A * 7/1990 Kurth ..... 248/101
5,056,545 A 10/1991 Spaeth
D325,297 S * 4/1992 Lipscomb et al. ..... D3/7
5,396,916 A * 3/1995 Boissonnault ..... 135/16
5,697,624 A 12/1997 Faraj
5,839,461 A 11/1998 Lambeth, Jr.
6,182,877 B1 * 2/2001 Rolfe ..... 224/407
2003/0136436 A1 * 7/2003 Stepp ..... 135/66

FOREIGN PATENT DOCUMENTS

JP 10-85015 * 4/1998
WO WO 97/13488 * 4/1997

* cited by examiner

*Primary Examiner*—Winnie Yip

(57) ABSTRACT

A walking cane device which supports a basket (2) and lid (7), permitting a storage area to transport objects. A support ring (4) and support columns (3) are secured to the shaft of the cane (1). The support columns (3) extend upwards and slightly outward of the shaft and along the sides of the basket (2), securing and stabilizing the basket (2) in place. A lid (7) is attached to the basket (2) by means of the attachment of the loops (6) to fasteners (5).

1 Claim, 2 Drawing Sheets

BASKETCANE

BACKGROUND OF THE INVENTION

1. Field of Invention

This invention relates to walking canes, specifically to such canes, which allow for the transportation of objects.

2. Description of Prior Art

The users of walking canes with limited mobility have a great need to have an accessible, secure and lightweight means to carry personal items. A couple examples of personal items would be keys, medicine and glasses.

Therefore several inventors attempted to address one or more of these concerns. U.S. Pat. No. 5,839,461 to Lambeth JR. (1998) demonstrates a defensive apparatus for hikers, walkers, joggers and security persons with sections housing electrical means, fluids and another section for storage. U.S. Pat. No. 5,697,624 to Faraj (1997) describes a wheeled cane-like structure with a multitude of hooks and a small storage compartment for grocery shopping. U.S. Pat. No. 5,056,545 to Spaeth (1991) illustrates a safety walking cane which employs the use of horns, a mirror, light reflector, water supply reservoir and an audible playback device.

All three patents (U.S. Pat. Nos. 5,839,461, 5,697,624 and 5,056,545) allow the user of a walking cane to store personal items. However, the space allocated for personal items for U.S. Pat. Nos. 5,056,545 and 5,839,461 are very limited, and in the case of U.S. Pat. No. 5,697,624 the available enclosed space is even more limited.

Additionally, U.S. Pat. Nos. 5,056,545 and 5,839,461 reference a vast number of features to assist in safety, which result in adding weight to the cane. In the case of U.S. Pat. No. 5,697,624, items are intended to be hung on the hooks, creating a very unstable environment. The accumulated weight associated with all three U.S. patents would be problematic for the users of the walking devices; especially for someone with limited mobility.

BACKGROUND OF THE INVENTION—OBJECTS AND ADVANTAGES

Accordingly, several objects and advantages of my invention are to provide a walking cane with a basket-like storage area.

It is an object to have a highly accessible storage area.

It is another objective of the invention to allow the user of the invention to secure personal items from falling from the cane if it is tilted or dropped while in use with a lid.

A further object of the invention is to provide a lid which can be locked.

Still another object of the invention is to ensure the basket and lid are lightweight to enable the user the ability to increase the number of items that are carried while minimally increasing the overall weight.

Further objects and advantages of my invention will become apparent from a consideration of the drawings and the ensuing description.

DRAWINGS—FIGURES

Figure 1:
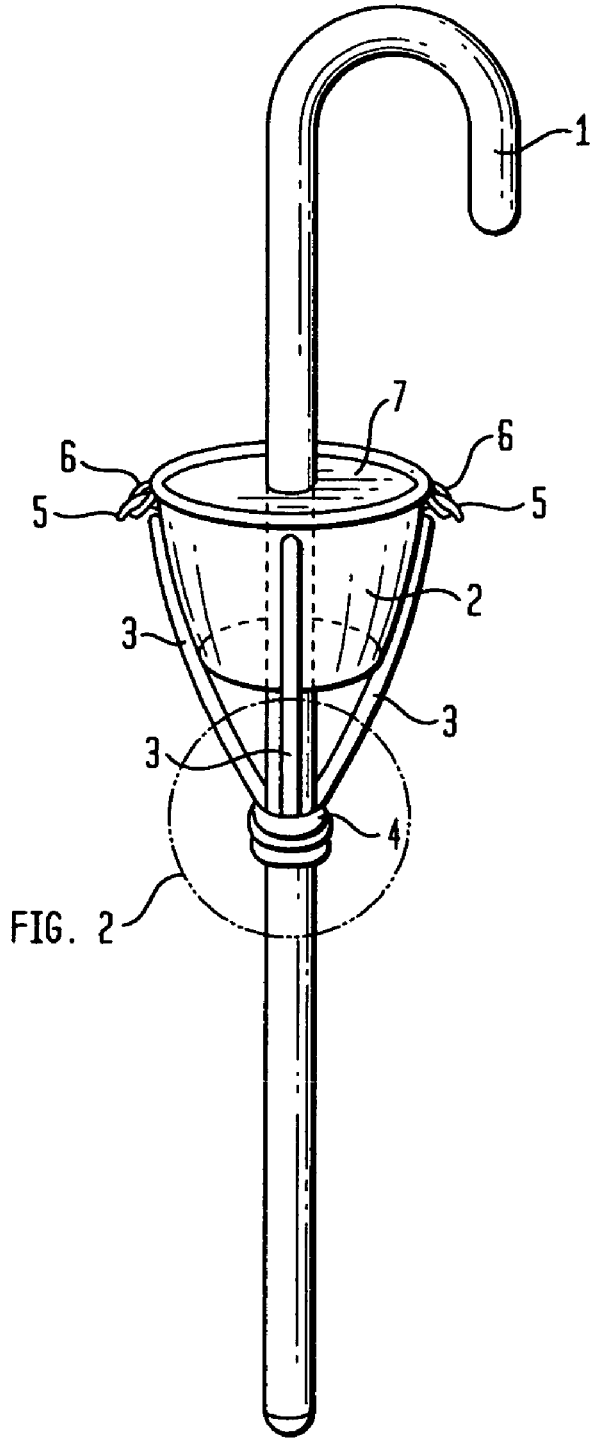
FIG. 1 shows a view of a cane which has a lid attached to a basket.

| DRAWINGS - REFERENCE NUMERALS | |
|---|---|
| 1 | cane |
| 2 | basket |
| 3 | support columns |
| 4 | support ring |
| 5 | fasteners |
| 6 | loop |
| 7 | lid |

DETAILED DESCRIPTION—FIGS. 1 TO 3

FIG. 1 shows an overall view of a basketcane. A support ring (4) is secured to a shaft of a cane (1) (various means could be used to secure the support ring; by gluing/cementing, screwing or bolting). The support ring (4) anchors support columns (3) to the cane (1). Support columns (3) are housed between the support ring (4) and the cane (1). The support columns (3) extend upward and slightly outward along the sides of the basket (2). The support columns (3) are secured to the basket (2) along the points of intersection, depending on the type of basket that is utilized the support columns (3) could be woven, glued or cemented into place. The basket (2) could be constructed out of bamboo. A lid (7) and basket (2) both contain a circular opening at its respective midpoints which allow the shaft of the cane (1) to pass through. The lid (7) will rest along the top of the basket (2). Additionally, the lid (7) maintains two loops (6), one on each side, which align to two fasteners (5), which reside on the sides of the basket (2). The loops (6) are shown attached to the fasteners (5) of the basket (2).

Figure 2:
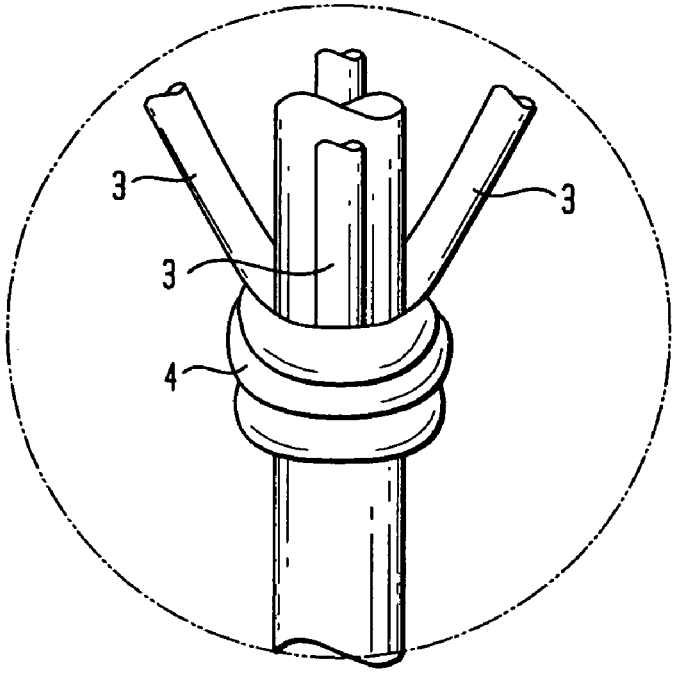
FIG. 2 shows a mid-section view of the cane and view of a support ring and support columns.

FIG. 2 shows a mid-section view of the cane (1). In this drawing, the intersection of the lower portion of the support columns (3) and the support ring (4) is illustrated.

Figure 3:
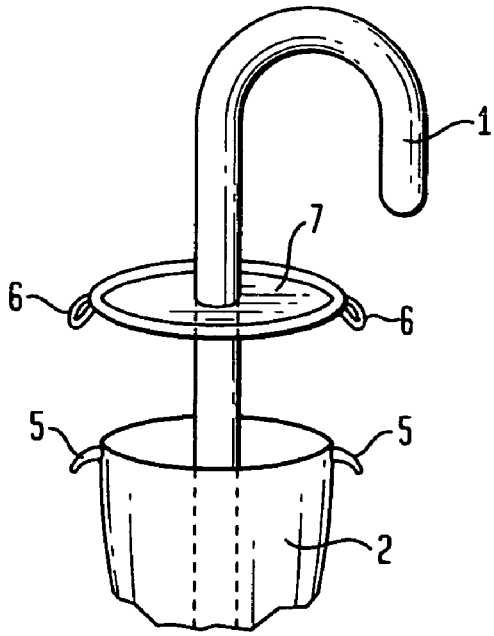
FIG. 3 shows a view of the cane which has the lid detached from the basket.

FIG. 3 shows the lid (7) raised on the shaft of the cane (1). Additionally, the loops (6) are shown detached from the fasteners (5).

From the description above, a number of advantages of my basketcane become evident.

(a) the lid (7) could be opened and closed quickly.

(b) there are only three main components.

(c) the user could reduce the number of items maintained in one's pockets, wallet/purse or jacket.

(d) The accessibility of the basket (2) will allow the user quick access to the contents, such as keys; allowing for a quick entry.

Operation—FIGS. 1 TO 3

The operation of the basketcane is quite simple. To open the basket (2), the user would unhook/unfasten the loops (6) from the fasteners (5) by pulling each loop (6) away from the basket (2) and each fastener (5). The user would now grab the lid (7) and slide the lid (7) up the cane (1), until the desired height is reached. The user could now add or remove items into/from the interior of the basket (2). To close the basket (2), the user would slide the lid (7) down the cane (1), until it rests along the top of the basket (2). Then the user would grab each loop (6) and push on each fastener (5). The basket (2) is now closed and secure.

SUMMARY, RAMIFICATIONS, AND SCOPE

Accordingly, the reader will see that the basketcane can be opened and closed easily and conveniently. Furthermore, the basketcane has additional advantages in that it provides a secure environment for the items stored in the basket;

it permits one to carry additional personal items;

it provides an extremely accessible space;

the basket and lid are lightweight.

Although the description above contains many specificities, these should not be construed as limiting the scope of the invention but rather as an exemplification of one preferred embodiment of this invention. Many other variations are possible. For example, the support ring could be placed closer to the base of the basket. Also, to secure the basket, Velcro or a snapping mechanism could be used in place of loops. In addition, the support columns could be made out of bamboo, metal, plastic, rubber and the basket could be made of bamboo, other types of wood, plastic, leather, or nylon.

Thus the scope of the invention should be determined by the appended claims and their legal equivalents, rather than by the examples given.

We claim:

1. A cane comprising:

(a) a basket, (b) a support ring affixed to said cane and support columns, (c) said support columns extending upwards from said support ring to sides of said basket, (d) a lid, (e) means for detaching and attaching said lid, (f) loops, (g) said loops affixed to said lid, (h) fasteners affixed to said basket, (i) said loops cooperating with said fasteners to lock said cane.

* * * * *